US005367924A

United States Patent [19]

Henson et al.

[11] Patent Number: 5,367,924

[45] Date of Patent: Nov. 29, 1994

[54] SUPPORT ARM FOR A POWER SCREWDRIVER

[75] Inventors: John D. Henson; Timothy J. Offutt, both of Logansport, Ind.

[73] Assignee: EDLO Sales & Engineering Inc., Logansport, Ind.

[21] Appl. No.: 97,652

[22] Filed: Jul. 26, 1993

[51] Int. Cl.[5] ..... B25B 23/00; B25H 1/00

[52] U.S. Cl. ..... 81/57.4; 81/462; 81/57.24

[58] Field of Search ..... 81/462, 57.24, 57.4, 81/DIG. 1; 248/280.1, 279

[56] References Cited

U.S. PATENT DOCUMENTS

| | | | |
|---|---|---|---|
| 2,471,793 | 5/1949 | Stull | 81/57.4 X |
| 3,333,613 | 8/1967 | Bosse | 81/57.4 |
| 4,271,730 | 6/1981 | Höll et al. | 81/57.24 |
| 4,782,726 | 11/1988 | Ryder et al. | 81/57.24 X |

*Primary Examiner*—D. S. Meislin
*Attorney, Agent, or Firm*—James D. Hall

[57] ABSTRACT

A support arm for supporting a power screwdriver or similar device. The support arm prevents the transmission of the rotational force generated by the screwdriver to the hands and wrists of the operator. The support arm includes an internal lock plate secured to an extensible rod, which is disposed within a generally square outer housing. The internal lock includes a pair of generally square lock plates mounted on either side of a Teflon® guide sleeve, which acts as a slide bearing. The sides of the lock plates are flat and are used to abut against the interior flat surfaces to prevent the extensible rod from rotating inside the housing. A pair of universal joints are connected to the housing and rod to permit limited pivotal movement. The support arm may be mounted to a shiftable carriage, which rides on a transverse railing.

7 Claims, 4 Drawing Sheets

SUPPORT ARM FOR A POWER SCREWDRIVER

This invention relates to a support arm for a power screwdriver, and particularly a support arm that allows unrestricted pivotal and axial movement while preventing the transmission of rotational torque generated by the screwdriver to the hands and wrists of the operator.

BACKGROUND OF THE INVENTION

Power screwdrivers are commonly used in manufacturing assembly lines to insert and drive screws, bolts and other turn-in fasteners quickly and accurately. An assembly line operator may drive as many as 7,000 screws during a normal work day. Typically, powered screwdrivers are heavy hand operated pneumatic or electrical units. To reduce operator fatigue, mechanical support arms have been developed to carry the weight of the drivers, while allowing the operators to manipulate the screwdrivers in a full range of motion. Generally, a support arm includes a pair of universal joints and a telescoping member to support the screwdriver from a wall ceiling or a stationary stand. A tensioning device supports the weight of the screwdriver and helps maintain the support arm at the correct attitude. The operator may grasp and manipulate the screwdriver to any operational position.

As commonly known, the universal joints of the mechanical arm allow limited freedom of movement in any direction, but permit full 360° rotational movement. Consequently, the rotational moment generated by the driver is transmitted directly into the telescoping member. Conventional telescoping members permit the extensible rod to rotate freely with the outer housings. Consequently at the penetration limit of the screw, the rotational torque generated by the power screwdriver is absorbed and arrested by the operator's hand. In high volume operations common in manufacturing assembly lines, the repetitious physical stress of absorbing the transferred rotation torque leads to various overuse injuries in the ligaments and tendons in the wrist and hand, and fatigues the operators, which reduces productivity.

SUMMARY OF THE INVENTION

The support arm of this invention eliminates the repetitive physical stress on the operator's hands and wrists caused by the transmission of rotational torque through the support arm. The support arm of this invention arrests the transfer of the rotational torque generated by the screwdrivers. The rotational torque is arrested by an internal slide lock secured to the extensible rod and disposed within a square outer housing. The internal slide lock includes a pair of square stop plate mounted on either side of a Teflon® guide sleeve, which acts as a slide bearing. The flat sides of the stop plates prevent the extensible rod from rotating inside the outer housing, thereby isolating the operator form the rotational force. In addition, the support arm may be mounted to a shiftable carriage, which rides on an elongated rail mounted to a support structure to allow a greater range of movement and a larger operational area.

Accordingly, an object of this invention is to provide for novel and unique support arm for connecting a power screwdriver to a support structure.

Another object is to provide for a support arm which allows unrestricted movement and extension while eliminating the transfer of rotational torque from the power drivers to the hands and wrists of the operator.

Another object is to provide for a support arm which is pivotally carried by a linearly shiftable carriage mounted to a support structure to increase the operational range of the screwdriver.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize its teachings.

Figure 1:
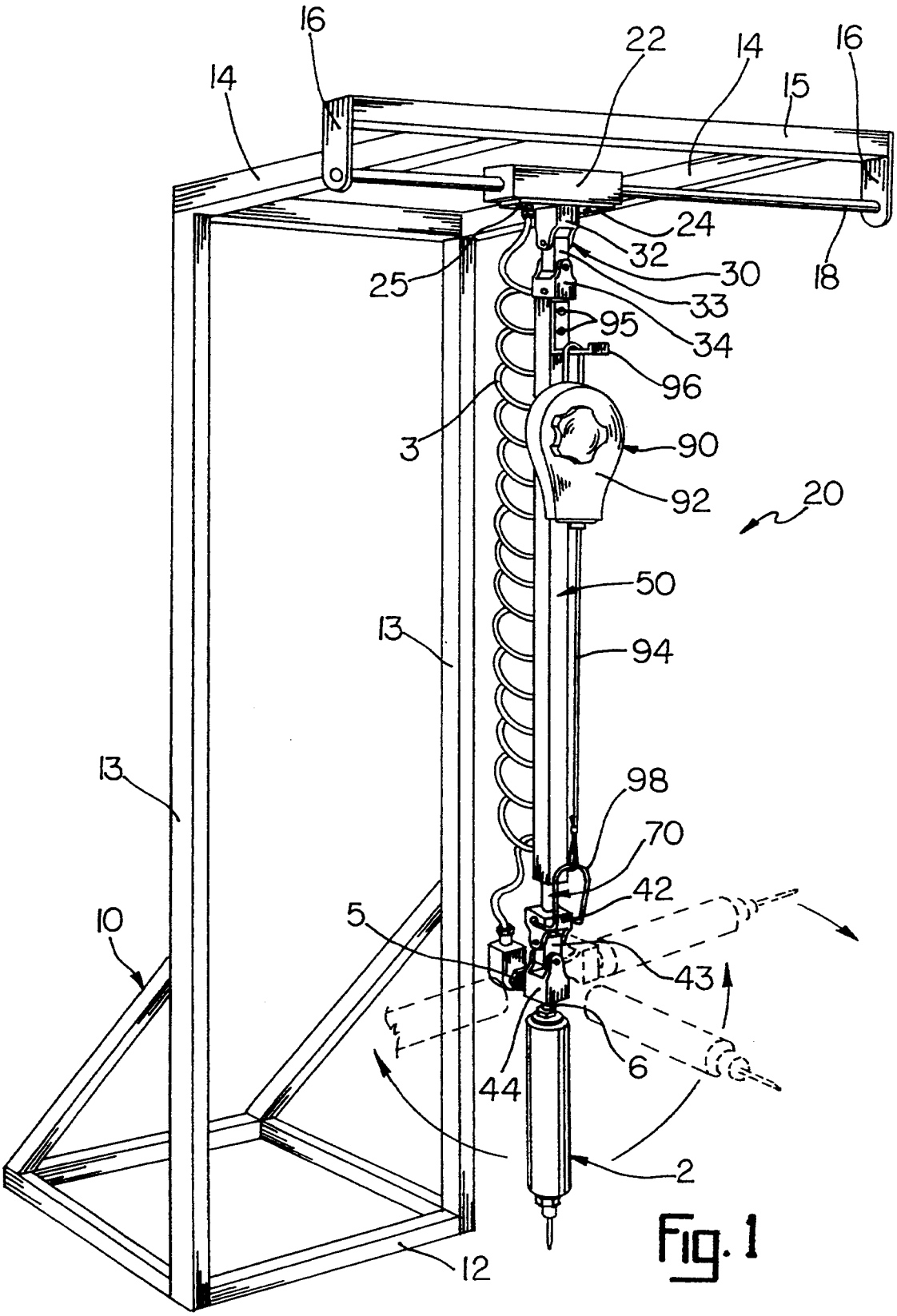
FIG. 1 is perspective view of the power screwdriver support stand using the support arm of this invention.
Figure 2:
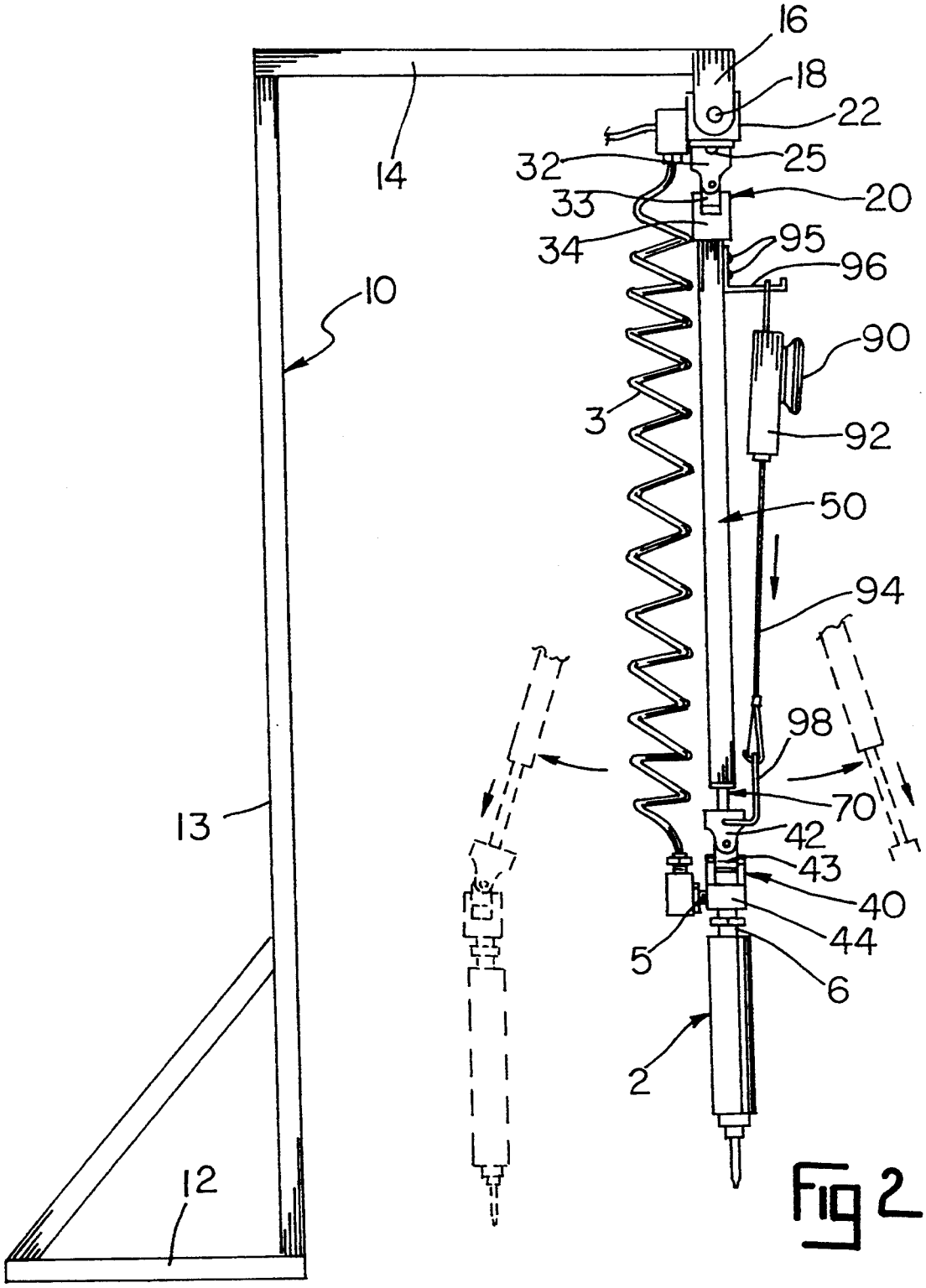
FIG. 2 is a side elevational view of the support stand and support arm of this invention.

FIGS. 1 and 2 show the support arm 20 of this invention vertically mounted to a support stand 10 and supporting a conventional power operated screwdriver 2. Although shown in use with a vertical support stand 10, support arm 20 of this invention can be adapted for use with any fixed support structure such as a wall, ceiling, or other stationary structure. Also, support arm 20 can be mounted in any orientation, i.e., horizontally or vertically, depending on the particular application. A conventional power screwdriver 2 is fitted to the free end of the support arm 20. Any conventional power screwdriver can be adapted for use with the support arm 20, such as the pneumatic screwdrivers manufactured by Atlas Copco. Although the figures illustrate a pneumatic screwdriver, electrical and other types of powered screwdrivers can be used.

Support stand 10 includes a base 12, a pair of parallel uprights 13 extending from base 12, and a pair of horizontal extension arms 14 mounted atop uprights 13. A horizontal cross beam 15 is connected laterally across the forward ends of extension arms 14. Cross beam 15 supports a parallel slide rail 18 between two end plates 16. Slide rail 18 is substantially horizontal and parallel to cross beam 15.

Support arm 20 is mounted to a trolley or carriage 22. Carriage 22 has a longitudinal bore 23 therethrough. Carriage 22 rides on slide rail 18, which extends through said bore 23. Carriage 22 may house bearings or other slide components (not shown), which allows relatively frictionless movement along slide rail 18. With support arm 20 mounted to carriage 22, support arm 20 can be translated horizontally across the length of slide rail 18 to increase the operational range of the screwdriver.

Figure 4:
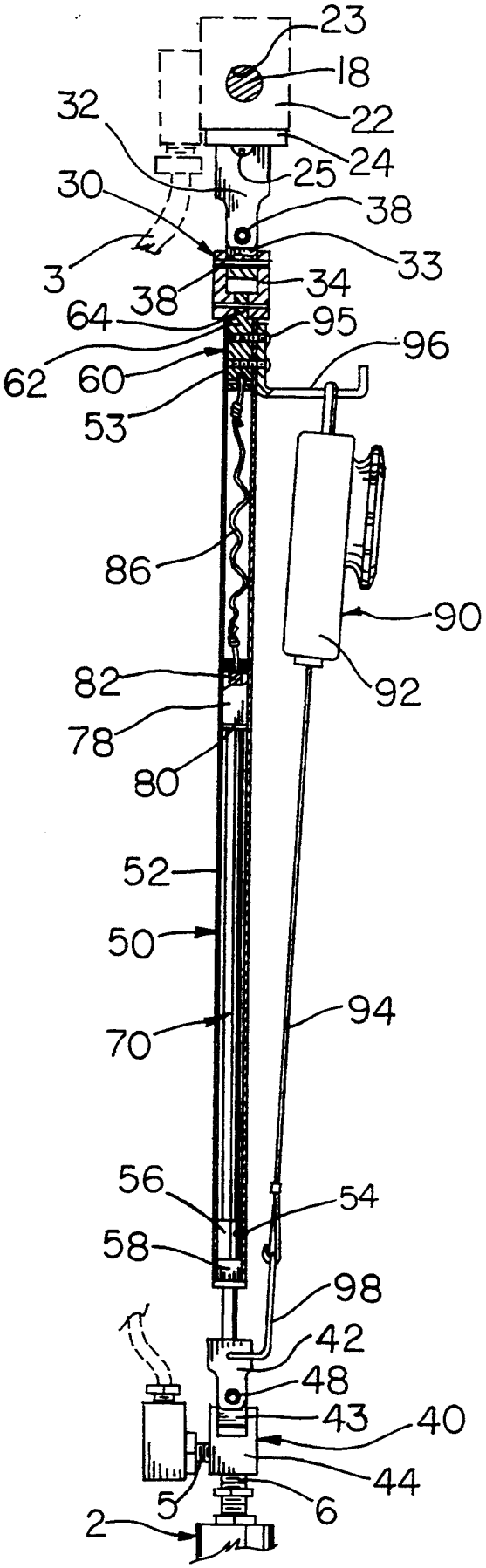
FIG. 4 is a side elevational view of the carriage and tensioning device with the internal components of the support arm shown in section form.

Support arm 20 includes an elongated outer housing 50. Housing 50 is preferably a hollow metal extrusion and includes four side walls 52, which define an interior compartment 51 with a substantially square cross section. Housing 50 has an upper end 53 and a lower end 54. Upper end 53 has two longitudinally aligned holes 55 in one side wall 52. As shown, an upper insert part 60 is secured to upper end 53 of housing 50 within compartment 51. Insert part 60 has an elongated rectangular body 62 with an upper cylindrical neck 64. Neck 64 has a lateral throughbore 65. Insert body 62 has a pair of threaded bores 66 along one side. The bottom of insert body 62 has ears 69, which defines a slot 68. A bore 67 passes through ears 69 as shown. As shown in FIG. 4, insert part 60 is fitted into the upper end 53 of housing 50. A tensioning device hanger 96 is connected to housing 50 by screws 95, which extend through holes 97 in hanger 96, housing holes 55 and are turned into threaded bores 66 of insert part 60.

As shown in FIG. 4, a bushing 56 is press fitted into open end 54 of housing 50. Bushing 56 is preferably formed of metal and defines a cylindrical sleeve with a friction reducing coating, such as Teflon® applied to its inner surface 57. Bushing 56 is inserted into housing 50 a partial distance from lower end 54. The tension generated from the rolled metal holds bushing 56 in place within housing 50. An end cap 58 is inserted into housing 50 and abut bushing 56. End cap 58 has a circular opening 59 to accommodate an extensible rod 70.

Figure 3:
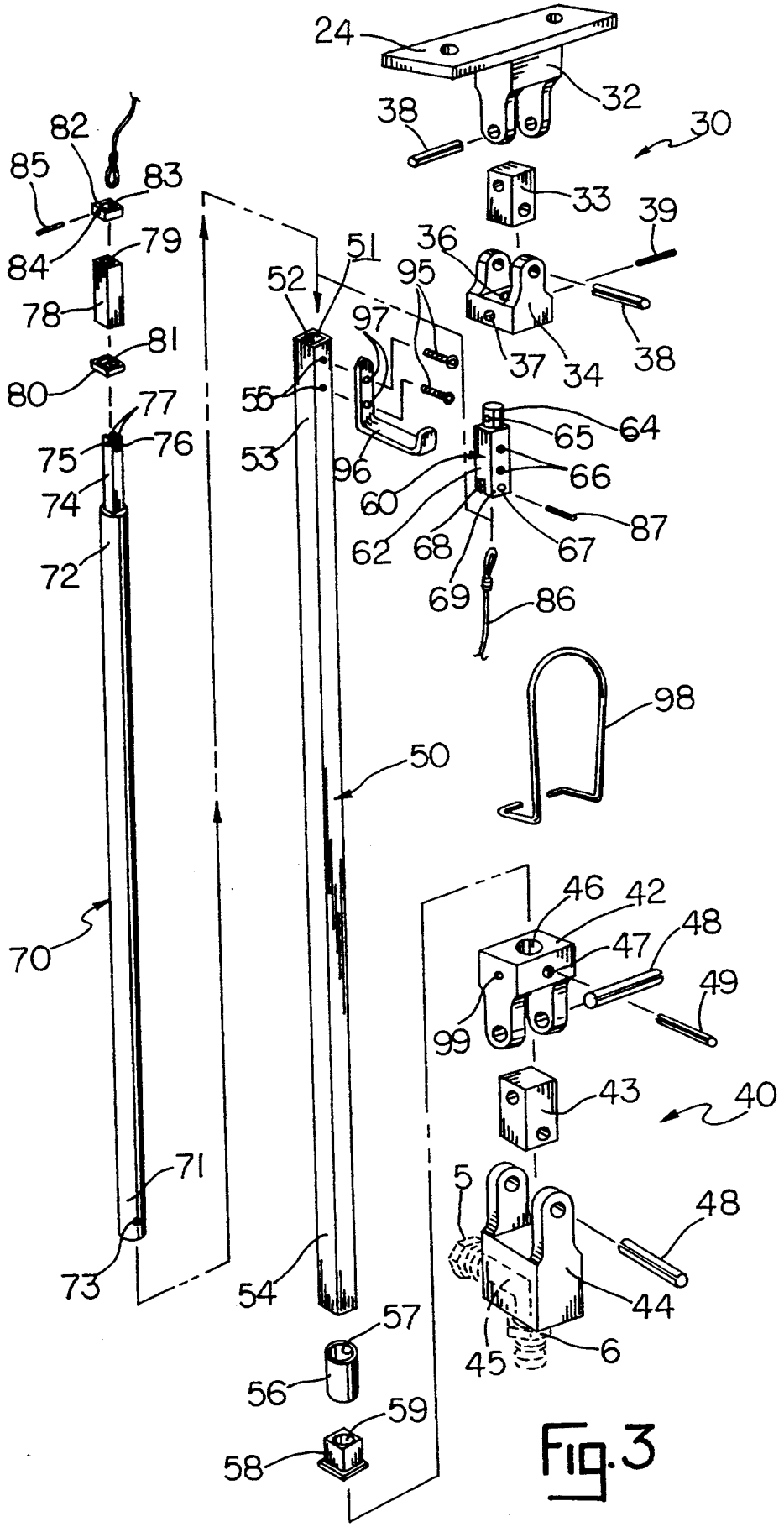
FIG. 3 is an exploded view of the support arm.

Extensible rod 70 is an elongated cylindrical shank of steel or other suitable material. As shown in FIGS. 3 and 4, rod 70 has a lower end 71 and upper end 72 disposed with housing interior 51. A lateral throughbore 73 extends through rod 70 at end 71. A squared head section 74 extends axially from rod upper end 72. Head section 74 terminates with ears 77 which define longitudinal slot 76. A lateral bore 75 passes through ears 76.

A guide sleeve 78 and a pair of stop dics or plates 80, 82 are fitted onto head section 74. As shown, stop plates 80, 82 are generally square and have square central openings 81, 83 respectively. The dimension of openings 81, 83 closely approximate the dimensions of head section 74 to allow for a relatively snug fit. Stop plate 82 has a lateral bore 85 through two opposed sides. Guide sleeve 78 is constructed of a friction reducing material, such as Teflon®. As shown, guide sleeve 78 has a square cross section with a substantially square longitudinal opening 79. The outer dimensions of guide sleeve 78 is slightly greater than the dimensions of stop plates 80, 82. The outer dimensions of guide sleeve 78 closely approximate the inner diameter of housing compartment 51. Guide sleeve 78 is positioned between the upper and lower stop plates 80, 82 and is secured in place by pin 85 which extends through aligning bores 84 in stop plate 82 and bore 75 of head section 74. Therefore, rod 70 slides freely within housing interior compartment 51. Guide sleeve 78 and bushing 56 allow smooth frictionless sliding movement of rod 70 with housing 50 while preventing rotation of the rod.

Universal joints 30, 40 are of conventional design. Universal joint 30 includes a pair of yoke parts 32, 34 connected to a translation block 33 by pins 38 inserted into aligned pivot bores in yoke parts 32, 34 and block 33. Yoke part 32 is connected to a mounting plate 24 as by welding. Mounting plate 24 is secured beneath carriage 22 by any conventional method such as screws 25. Yoke part 34 has a longitudinal throughbore 36 and lateral throughbore 37, which passes through longitudinal bore 36. As shown, neck 64 of insert 60 extends outwardly from upper end 53 of housing 50. Neck 64 is secured within longitudinal bore 36 of yoke part 34 by fastening pin 39. Fastening pin 39 is inserted through aligned bore 65 of neck 64 and bore 37 of yoke part 34.

Universal joint 40 includes a pair of yoke parts 42, 44 connected to a translation block 43 by pins 45 inserted into aligned pivot bores in yoke parts 42, 44 and block 43. Yoke part 42 has a longitudinal throughbore 46 and lateral throughbore 47, which passes through longitudinal bore 46. Rod lower end 71 extends outwardly through bushing sleeve 64 and end cap 66 and is connected to universal joint 40. Rod end 77 is fitted within the longitudinal bore 46 of yoke part 42 and secured by a pin 49. Pin 49 extends through aligned hole 47 in yoke part 42 and rod bore 73. Yoke part 44 is adapted to accommodated the pneumatic connection for power screwdriver 2. Yoke part 44 has an internal air passage 45. Fitting 6 connects screwdriver 2 to yoke part 44 and fitting 5 connects air line 3 to yoke part 44. Universal joint 40 also includes a lower tensioning device hook 98 fitted within bores 99 in yoke part 42.

A cord 86 connects upper end 72 of rod 70 to insert part 60. One end of cord 86 is tied to pin 85 and the other end is tied to pin 87. The length of cord 86 limits the travel of rod 70 and prevents stop plate 82 from contacting bushing 56 and end cap 58.

A tensioning device 90 is connected between hanger part 96 and hook part 98. Tensioning device 90 supports the weight of power screwdriver 2 and allows mechanical arm 20 to be manipulated as needed. Tensioning device 90 includes a coiler housing 92 and a cable 94. Coiler housing 92 encloses the tensioning mechanism (not shown) which balances the weight of the power drive against the recoil of the tensioning device 90. Tensioning device housing 92 is hung from hanger part 96 as shown. Cable 94 extends from tensioning device housing 92 under tension and is connected to hook part 98.

In operation, universal joints 30, 40 allow support arm 20 to be pivoted and manipulated in any direction and angular orientation while the support arm's reach can be adjusted by extending rod 70 from housing 50. Once a screw is driven to its limit, the rotational torque generated by screwdriver 2 is transferred through universal joint 40 to rod 70. The rotational torque slightly deforms the relatively soft guide sleeve 78 to bring stop plates 80, 82 into contact with housing side walls 52. The engagement of stop plates 80, 82 with side walls 52 prevents further rotation of rod 70 within housing 50. Since housing 50 is affixed to carriage 22 by universal joint 30, the rotational moment generated by the screwdriver 2 is completely arrested by the static force of the stop plates. Consequently, the operator absorbs no force by holding or guiding screwdriver 2 during operation. The engagement of stop plates 80, 82 also provides a friction lock to help prevent the screwdriver from jerking away from the screw head, which can cause stripping. As the rotational torque increases, the stop plates engage the housing side walls with greater force, which prevents the rod from moving within the housing. The increased holding power helps the operator maintain the screwdriver at the proper attitude.

It is understood that the above description does not limit the invention to the details given, but may be modified within the scope of the following claims.

I claim:

1. In combination an extensible mechanical arm and power driver means for turning fasteners in place, said mechanical arm comprising:

an elongated housing having first and second ends and defining an elongated interior compartment having inner side walls, first pivot means interconnected between said housing first end and a connecting means for pivotally mounting said housing to a support structure, an extensible rod having a first end disposed within said housing interior compartment, and a second end extending outwardly from said housing second end, second pivot means interconnected between said rod second end and said power driver means for pivotally mounting said driver means to said extensible rod, locking means carried by said rod and disposed in said interior compartment for preventing rotational movement of said rod relative to said housing.

2. The combination of claim 1 wherein said locking means includes deformable guide means connected to said rod adjacent said rod first end and contacting said inner side walls for permitting substantially frictionless sliding movement of said rod, a stop plate connected to said rod adjacent to said guide means, said stop plate including a side wall having one or more flat outer surfaces located adjacent said interior compartment side walls whereby said rod is prevented from rotating within said compartment.

3. The combination of claim 1, and said connecting means including an elongated rail adapted for connection to said support structure, and carriage means carried by said rail for shiftably moving said support arm between opposite ends of said rail, said first pivot means connected between said housing first end and said carriage.

4. The combination of claim 1 wherein said first and second pivot means are universal joints.

5. In combination, a support structure, power driver means for turning fasteners in place, and a support arm connecting said power driver means to said support structure, said support arm comprising:

connecting means carried by said support arm for shiftably connecting said support arm to said support structure, an elongated housing having first and second ends defining an elongated interior having inner side walls, a first pivot means interconnected between said housing first end and said connecting means for pivotally mounting said housing and said connecting means, an extensible rod having a first end disposed within said housing interior compartment, and a second end extending outwardly from said housing second end, a second pivot means interconnected between said rod second end and said drive means for pivotally mounting said drive means to said extensible rod, and locking means carried by said rod and disposed in said interior compartment for preventing rotation movement of said rod.

6. The combination of claim 5 wherein said locking means includes deformable guide means connected to said rod adjacent said rod first end and contacting said inner side walls for permitting substantially frictionless sliding movement of said rod, and a stop plate connected to said rod adjacent to said guide means, said stop plate including a side wall having one or more flat outer surfaces located adjacent said interior compartment side walls whereby said rod is prevented from rotating within said compartment.

7. The combination of claim 5 wherein said first and second pivot means are universal joints.

* * * * *